US009812000B2

(12) United States Patent
Sivakumar et al.

(10) Patent No.: US 9,812,000 B2
(45) **Date of Patent: *Nov. 7, 2017**

(54) SYSTEM AND METHOD FOR AUTOMATED POSTING OF ALARM INFORMATION TO NEWS FEED

(71) Applicant: Honeywell International Inc., Morristown, NJ (US)

(72) Inventors: Balaji Badhey Sivakumar, Maduria (IN); Raja Manikandan, Maduria (IN); Vinoth D, Erode (IN)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/346,330

(22) Filed: Nov. 8, 2016

(65) Prior Publication Data

US 2017/0053522 A1 Feb. 23, 2017

Related U.S. Application Data

(62) Division of application No. 13/155,923, filed on Jun. 8, 2011, now Pat. No. 9,501,922.

(51) Int. Cl.

| | |
|---|---|
| ***G08B 1/08*** | (2006.01) |
| ***G08B 25/01*** | (2006.01) |
| ***G08B 25/10*** | (2006.01) |
| ***G08B 7/00*** | (2006.01) |
| ***G08B 25/00*** | (2006.01) |
| ***G08B 25/08*** | (2006.01) |
| ***G08B 25/14*** | (2006.01) |

(52) U.S. Cl.

CPC ..... *G08B 25/016* (2013.01); *G08B 7/00* (2013.01); *G08B 25/004* (2013.01); *G08B 25/08* (2013.01); *G08B 25/10* (2013.01); *G08B 25/14* (2013.01)

(58) Field of Classification Search

CPC ..... H04L 1/00; G06F 1/00

See application file for complete search history.

(56) References Cited

U.S. PATENT DOCUMENTS

| | | | |
|---|---|---|---|
| 6,798,344 | B2 | 9/2004 | Faulkner et al. |
| 7,633,385 | B2 | 12/2009 | Cohn et al. |
| 7,752,328 | B2 | 7/2010 | Mortimore, Jr. et al. |

(Continued)

FOREIGN PATENT DOCUMENTS

| | | | |
|---|---|---|---|
| GB | 2475706 | A | 6/2011 |
| WO | WO 2010/017588 | A1 | 2/2010 |

OTHER PUBLICATIONS

European Search Report, dated Sep. 28, 2012, corresponding to Application No. EP 12 16 9400.

(Continued)

*Primary Examiner* — Shirley Lu

(74) *Attorney, Agent, or Firm* — Husch Blackwell LLP

(57) ABSTRACT

Systems and methods for automated posting of alarm information to a news feed are provided. Some methods can include configuring a plurality of surveillance devices, configuring a notification platform, configuring a plurality of alarm types, and providing a remote notification to a mobile handheld device via the notification platform when an alarm that is at least one of the plurality of alarm types occurs in at least one of the plurality of surveillance devices.

7 Claims, 11 Drawing Sheets

(56) References Cited

U.S. PATENT DOCUMENTS

| | | | | |
|---|---|---|---|---|
| 2006/0022816 | A1 | 2/2006 | Yukawa | |
| 2007/0067725 | A1* | 3/2007 | Cahill | G05B 23/027 715/733 |
| 2009/0204689 | A1* | 8/2009 | Chipman | G08B 13/19656 709/219 |
| 2010/0245072 | A1 | 9/2010 | Harel | |

OTHER PUBLICATIONS

"Twitter Burglar Alarm," URL:http://www.kelvinsthunderstorm.com/2009/02/twitter-burglar-alarm/ (Feb. 9, 2009).
"Burglar alarm with SMS/twitter", URL: http://arduino.cc/forum/index.php/topic,8607.0.html (Feb. 10, 2009).

* cited by examiner

1100

HEALTH REPORT - REM-1234 (199.63.55.92)

| NAME | DATE | COUNT |
|---|---|---|
| NO VIDEO RECORDING | 11/02/2010 | 1 |
| REBOOT | 11/02/2010 | 1 |

BACKDOOR REPORT - REM-1234 (199.63.55.92)

| DOOR | DATE | BACKDOOR | AFTER DARK |
|---|---|---|---|
| BACK DOOR | 11/2/2010 12:00:00 AM | 4 | 0 |
| SIDE DOOR | 11/2/2010 12:00:00 AM | 4 | 0 |
| DELIVERY DOOR | 11/2/2010 12:00:00 AM | 4 | 0 |
| CAR COUNT STRIP | 11/2/2010 12:00:00 AM | 4 | 0 |
| COOLER DOOR | 11/2/2010 12:00:00 AM | 3 | 0 |
| INPUT6 | 11/2/2010 12:00:00 AM | 3 | 0 |
| INPUT7 | 11/2/2010 12:00:00 AM | 3 | 0 |
| INPUT8 | 11/2/2010 12:00:00 AM | 3 | 0 |

CONNECTION REPORT- SUMMARY

| SITE NAME | STATUS |
|---|---|
| 0 PANERACARES - ST LOUIS | |
| McDONALDS EAST | |
| McDONALDS_UAS_WEST | |

*FIG. 11*

SYSTEM AND METHOD FOR AUTOMATED POSTING OF ALARM INFORMATION TO NEWS FEED

CROSS-REFERENCE TO RELATED APPLICATIONS

This application is a divisional of and claims the benefit of the filing date of U.S. Application Ser. No. 13/155,923 filed Jun. 8, 2011.

FIELD OF INVENTION

The present invention relates generally to video surveillance. More particularly, the present invention relates to systems and methods for automatically posting alarm information in a video surveillance system to a news feed.

BACKGROUND

Video surveillance systems are integral to many security systems. For example, many video surveillance systems include surveillance cameras, video recorders, controllers, and viewers. In operation, a video surveillance system can generate an alarm when certain events occur, for example, when a camera detects motion, when a door sensor is triggered, or when hard disk storage space is low. When these and other types of alarms are generated, the alarm can be reported to an operator monitoring the system, and the operator can take the necessary action based on the nature of the alarm.

When an increasing number of video surveillance systems are employed to monitor a premise, security operators must monitor a huge number of alarms from the various systems. Monitoring the alarms can include analyzing video from cameras associated with the alarms and taking a corresponding action.

Thus, in some cases, each alarm may require attention from a different user. For example, a user could be an operator monitoring a specific set of surveillance cameras or an administrator monitoring the entire premise. Each alarm may also require a different set of actions to be taken by the corresponding user. For example, some of the alarms might be critical and need to be communicated to a user without delay.

In known security systems, there are various ways to notify a user about an alarm. For example, specialized software or live dashboard services could be used to notify the user. The user could also be notified by email or text/short message services (SMS). However, each of these notification methods has disadvantages.

For example, when specialized software is used, the software must be installed in the system. Furthermore, the specialized software does not report the alarm to a user when the user is at a remote location. While email or SMS can notify a user at a remote location, the notification does not provide detailed information about the alarm, and the user does not have enough information to determine the appropriate course of action.

There is, thus, a continuing, ongoing need for systems and methods to report alarms from a video surveillance system to users in a remote location and to provide the users with sufficient information for the users to determine an appropriate course of action. Preferably, such systems and methods automatically post alarm information to a news feed.

BRIEF DESCRIPTION OF THE DRAWINGS

FIG. 11 is a window displayed on a viewing screen of a handheld device for providing remote notification of multiple alarms in accordance with the present invention.

DESCRIPTION OF THE PREFERRED EMBODIMENTS

Figure 1:
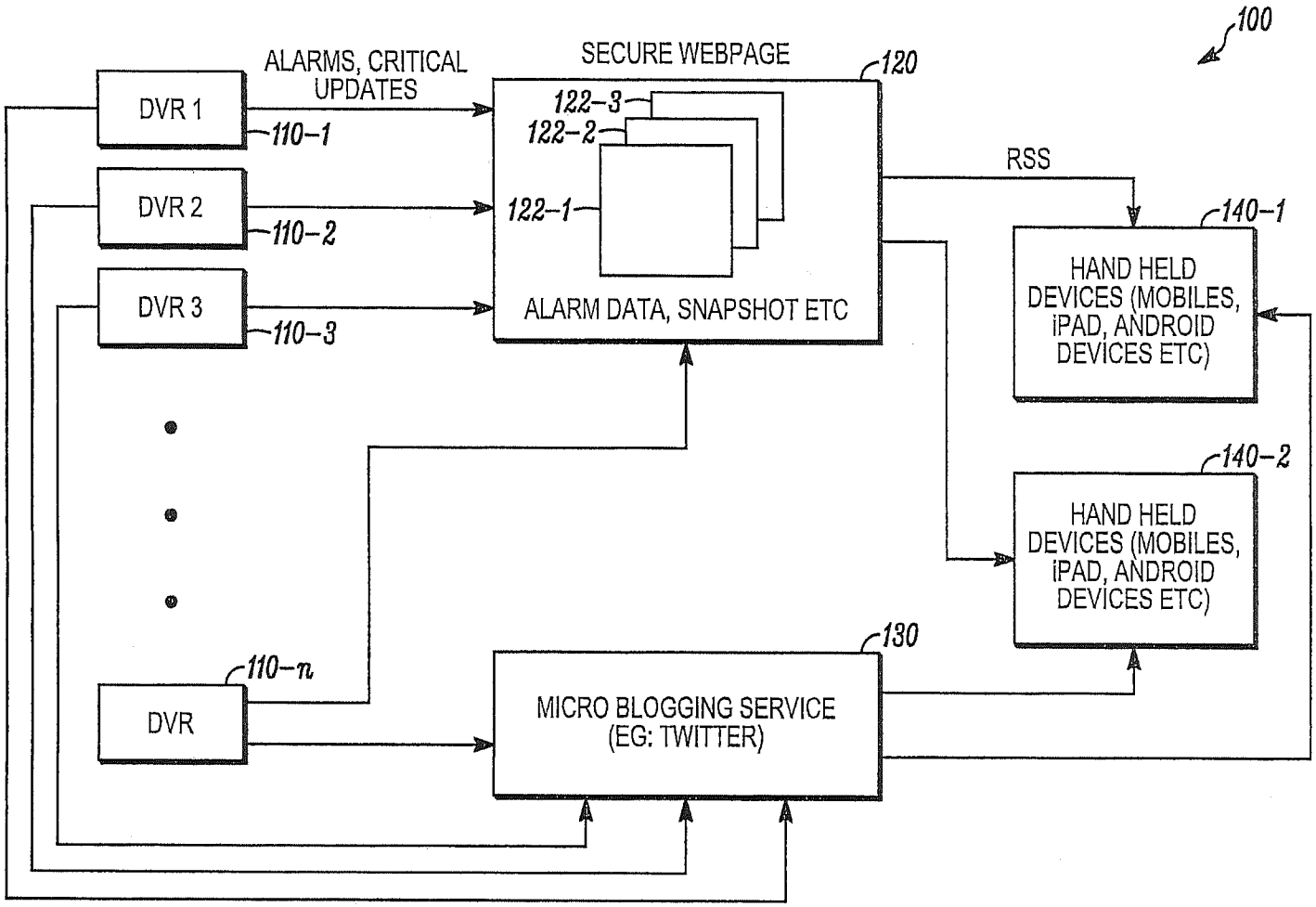
FIG. 1 is a block diagram of a system in accordance with the present invention.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments of the present invention include systems and methods to report alarms from a video surveillance system to users in a remote location and to provide the users with sufficient information for the users to determine an appropriate course of action. Preferably, such systems and methods automatically post alarm information to a news feed.

In accordance with the present invention, the reporting of alarms from a surveillance system is fast, and all alarm information is readily available to a user. For example, the occurrence of an alarm and information associated therewith can be displayed to a user on the user's handheld mobile device, for example, a personal digital assistant or smart phone.

Systems and methods in accordance with the present invention can provide alarm updates in real time so a user can receive alarm notification substantially immediately. Furthermore, information associated with the alarm can be presented to the user so that the user can easily make a quick decision regarding the alarm.

Systems and methods in accordance with the present invention can also post alarm information to a secure web page that can only be accessed with proper authentication. In operation, a user can feel no difference between receiving an alarm notification and receiving any other update from a social networking website.

In embodiments of the present invention, when an alarm in the surveillance system occurs, a web or Hyper Text Markup Language (HTML) article can be created and posted to a web page. The HTML article can contain alarm information as well as associated data, such as, for example, hard disk utilization, device temperature, or screenshots of video from cameras associated with the alarm.

The web page on which HTML articles are posted can be Really Simple Syndication (RSS) enabled. The RSS enablement allows users to subscribe to updates from the web page through any commonly available reader software or through a web browser. For example, when an HTML article with alarm data is posted to the web page, a subscriber of the web page can receive an update on his handheld mobile device substantially immediately. Then, the user can preview the HTML article and take appropriate actions based on the nature of the alarm and any additional information provided.

In some embodiments of the present invention, alarm information is only posted to a secure page that can be accessed with proper authentication from web-based and/or HTML-based technologies.

Alarms, for example, critical alarms, and short data about the alarms can also be posted to a micro-blogging or social networking site, such as, for example, Twitter®. For example, the alarm and associated data can be posted to the site as an update through an authenticated user account. Thus, the user can be located anywhere and still receive the alarm and associated information via the Internet using a mobile handheld device without any pre-installed specialized software. In some embodiments, the alarm and associated data can be posted to the site substantially immediately after the alarm occurs.

In some embodiments, HTML articles can be created from data associated with multiple alarms from different surveillance systems. For example, a report of alarms, for example, critical alarms, from different surveillance systems can be collected and posted as one HTML article. A user can be located anywhere and receive substantially immediate alarm updates through an RSS enabled system. Then, the user can act upon the alarms, if necessary.

Systems and methods of the present invention can be used in connection with video surveillance systems for real time updates. Systems and methods of the present invention can also be used with a central station that manages a plurality of video surveillance systems and serves multiple end users.

In operation, surveillance devices from which updates are needed can be selected. Then, a web page on which updates will be posted can be configured, and the credentials for access to the web page can be configured. For example, social networking credentials for posting updates can be configured.

The type of alarms to be reported through the RSS enabled web page can be selected, and a user can subscribe to a particular RSS feed. Finally, a user can receive updates from the selected surveillance devices.

FIG. 1 is a block diagram of a system 100 in accordance with the present invention. As seen in FIG. 1, a plurality of digital video recorders (DVRs), for example, 110-1, 110-2, 110-3 . . . **110-*n*, can be in communication with a secure web page 120 and a social networking or micro blogging service 130. In some embodiments of the present invention, the DVRs 110-1, 110-2, 110-3 . . . 110-*n* can communicate with the secure web page 120 and the micro blogging service 130** via the Internet.

The DVRs 110-1, 110-2, 110-3 . . . **110-*n* can transmit alarms, critical updates, and associated information to the secure web page 120 and to the micro blogging service 130. The secure web page 120 can display a plurality of HTML articles 122-1, 122-2, 122-3** that include alarm and critical update data as well as associated information, for example, snapshots of the area in alarm.

The system 100 shown in FIG. 1 can also include a plurality of user handheld devices or smart phones 140-1, 140-2, for example, Blackberry®, Apple®, or Android® devices. In some embodiments, the secure web page 120 can communicate with at least one of the handheld devices, for example, 140-1, via an RSS feed.

Figure 2:
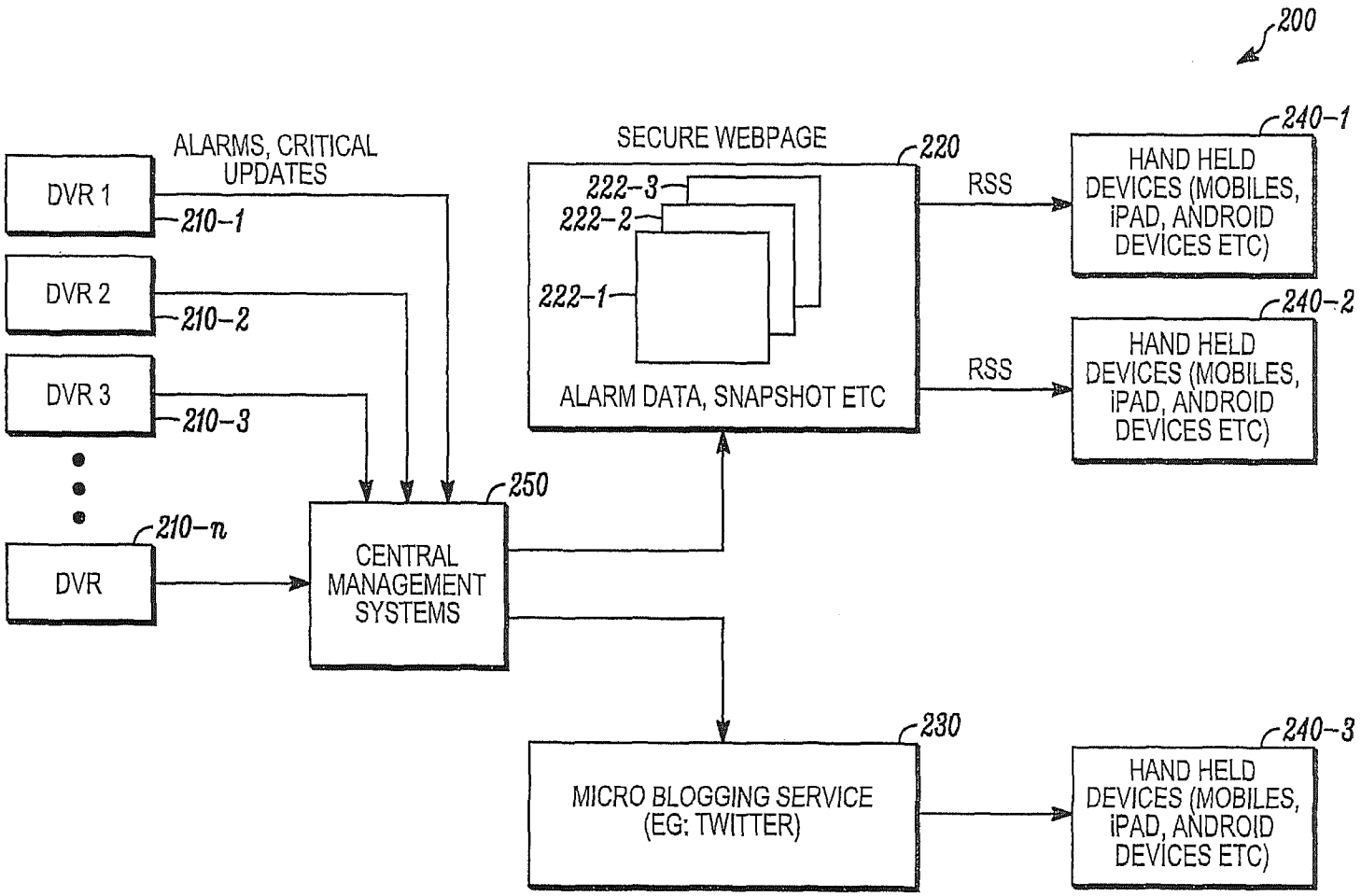
FIG. 2 is a block diagram of a system employing a central station in accordance with the present invention.

FIG. 2 is a block diagram of a system 200 employing a central station 250 in accordance with the present invention. The system 200 in FIG. 2 is substantially the same as the system 100 in FIG. 1 except that the DVRs 210-1, 210-2, 210-3 . . . **210-*n* in the system 200 communicate with the secure web page 220 and the micro blogging service 230 via the central station 250 rather than directly. The central station 250 can collect information from each of the DVRs 210-1, 210-2, 210-3 . . . 210-*n* and post the information in collective HTML articles 222-1, 222-2, 222-3 on the secure web page 220**.

The system 200 in FIG. 2 also differs from the system 100 in FIG. 1 in that the secure web page 220 communicates with a first plurality of handheld devices, for example, 240-1, 240-2, and the micro blogging service 230 communicates with a second plurality of handheld devices, for example, 240-3. In some embodiments, the secure web page 220 can communicate with each of the handheld devices 240-1, 240-2 in the first plurality via an RSS feed.

Figure 3:
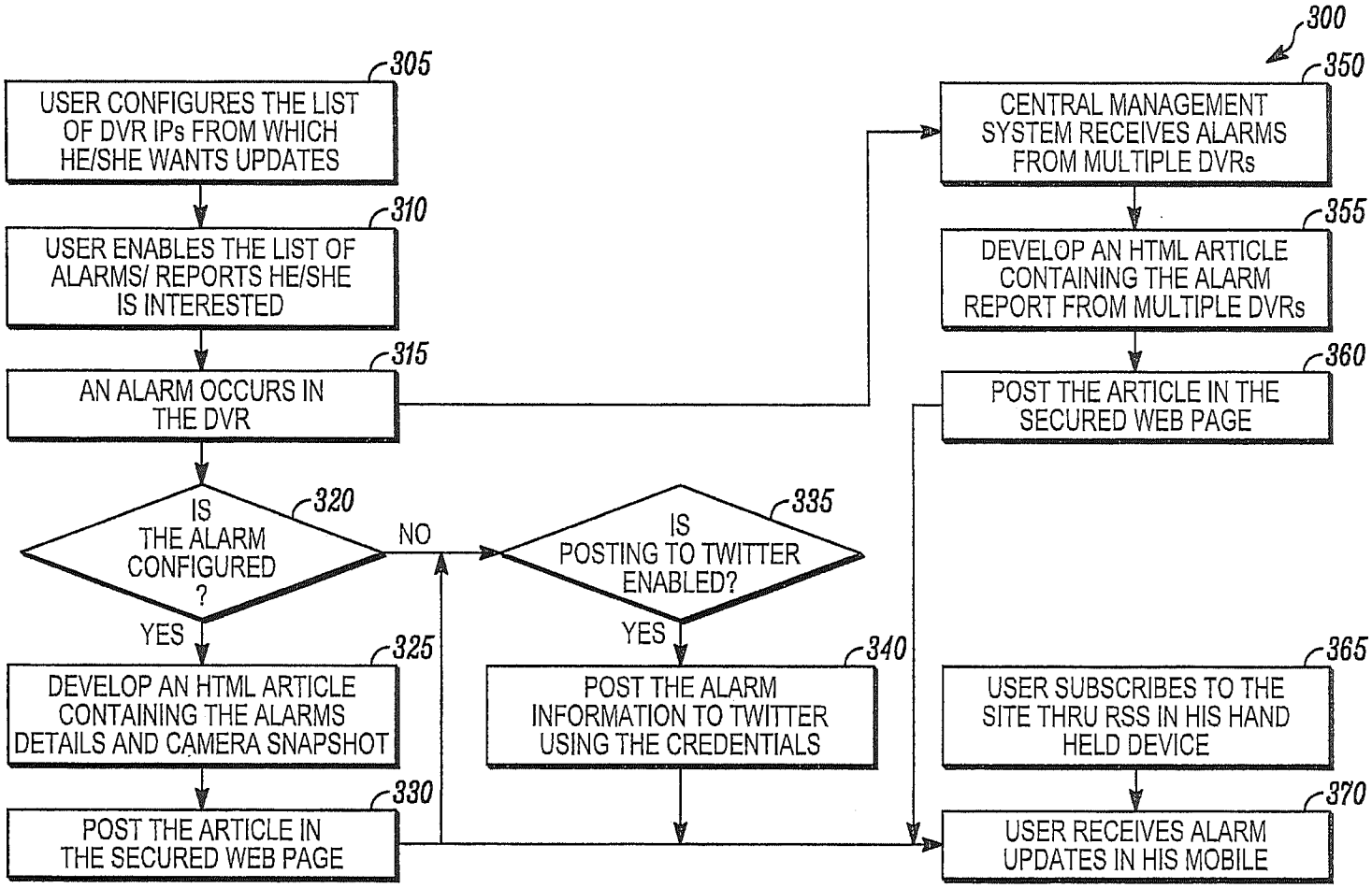
FIG. 3 is a flow diagram of a method in accordance with the present invention.

FIG. 3 is a flow diagram of a method 300 in accordance with the present invention. As seen in FIG. 3, a user can configure a list of DVR IP addresses from which he wants updates as in 305. Then, the user can enable a list of alarms and/or reports in which he is interested as in 310.

When an alarm occurs in a DVR as in 315, the method 300 can determine if the alarm is configured for the DVR in alarm as in 320, and a central station can receive an alarm notification from the DVR in alarm as in 350.

If the method 300 determines that the alarm is configured as in 320, then an HTML article containing the alarm details and a camera snapshot of the area in alarm can be configured as in 325. For example, the camera snapshot can be a picture of the area in alarm from the DVR in alarm. Then, the HTML article can be posted to a secure web page as in 330, and the user can receive an alarm update via his mobile device as in 370.

After the HTML article is posted to the secure web page as in 330 or if the method 300 determines that the alarm is not configured as in 320, then the method 300 can determine if posting to a social networking or micro blogging service is configured as in 335. If yes, then alarm information can be posted to the social networking or micro blogging service using secure credentials as in 340. Then, the user can receive an alarm update via his mobile device as in 370.

When the central station receives the alarm notification from the DVR in alarm as in 350, an HTML article containing alarm reports from multiple DVRs can be developed as in 355. Then, the HTML article containing the alarm reports from the multiple DVRs can be posted to a secure web page as in 360, and the user can receive alarm updates about the multiple DVRs via his mobile device as in 370.

As seen in FIG. 3, before the user receives alarm updates via his mobile device as in 370, the user can subscribe to receive updates as in 365. For example, the user can subscribe to a secure web page or a social networking or micro blogging service via an RSS feed to his handheld device.

Figure 4:
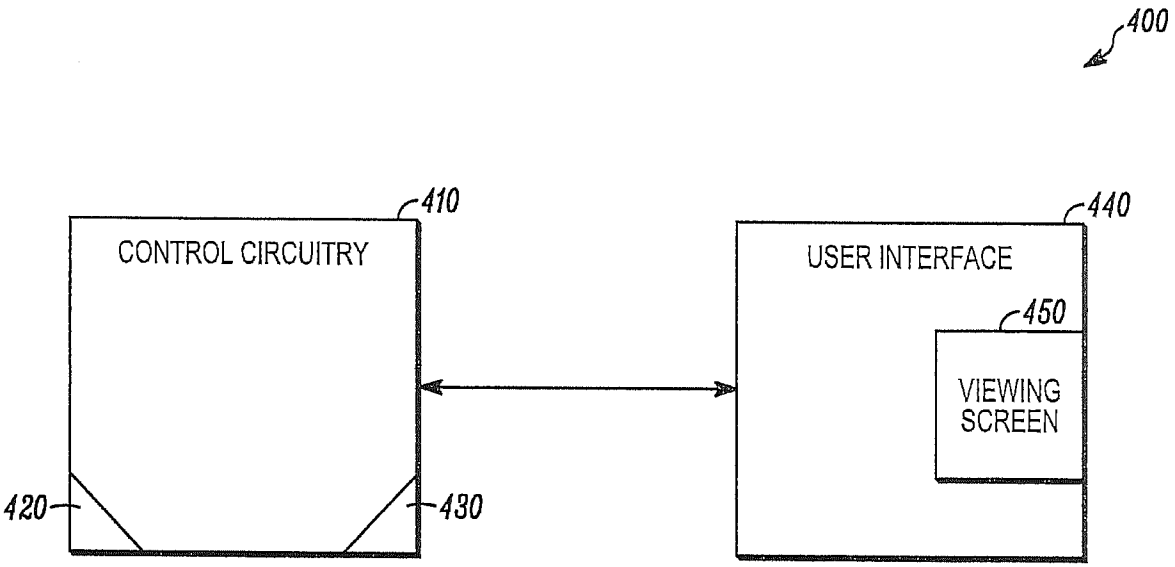
FIG. 4 is a block diagram of a system for carrying out the method of FIG. 3 in accordance with the present invention.

The method shown in FIG. 3 and others in accordance with the present invention can be implemented with the system 400 shown in FIG. 4. As seen in FIG. 4, the system 400 can include control circuitry 410, one or more programmable processors 420, and executable control software 430 as would be understood by those of skill in the art. The executable control software can be stored on a transitory or non-transitory local computer readable medium.

An associated user interface 440 can be in communication with the control circuitry 410, and a viewing screen 450 of the user interface 440, as would be known by those of skill in the art, can display interactive and viewing windows. In some embodiments of the present invention, the user interface 440 can be a multi-dimensional graphical user interface.

The interactive and viewing windows shown and described herein are exemplary only. Those of skill in the art will understand that the features of the windows shown and described herein can be displayed by additional or alternate windows.

Figure 5:
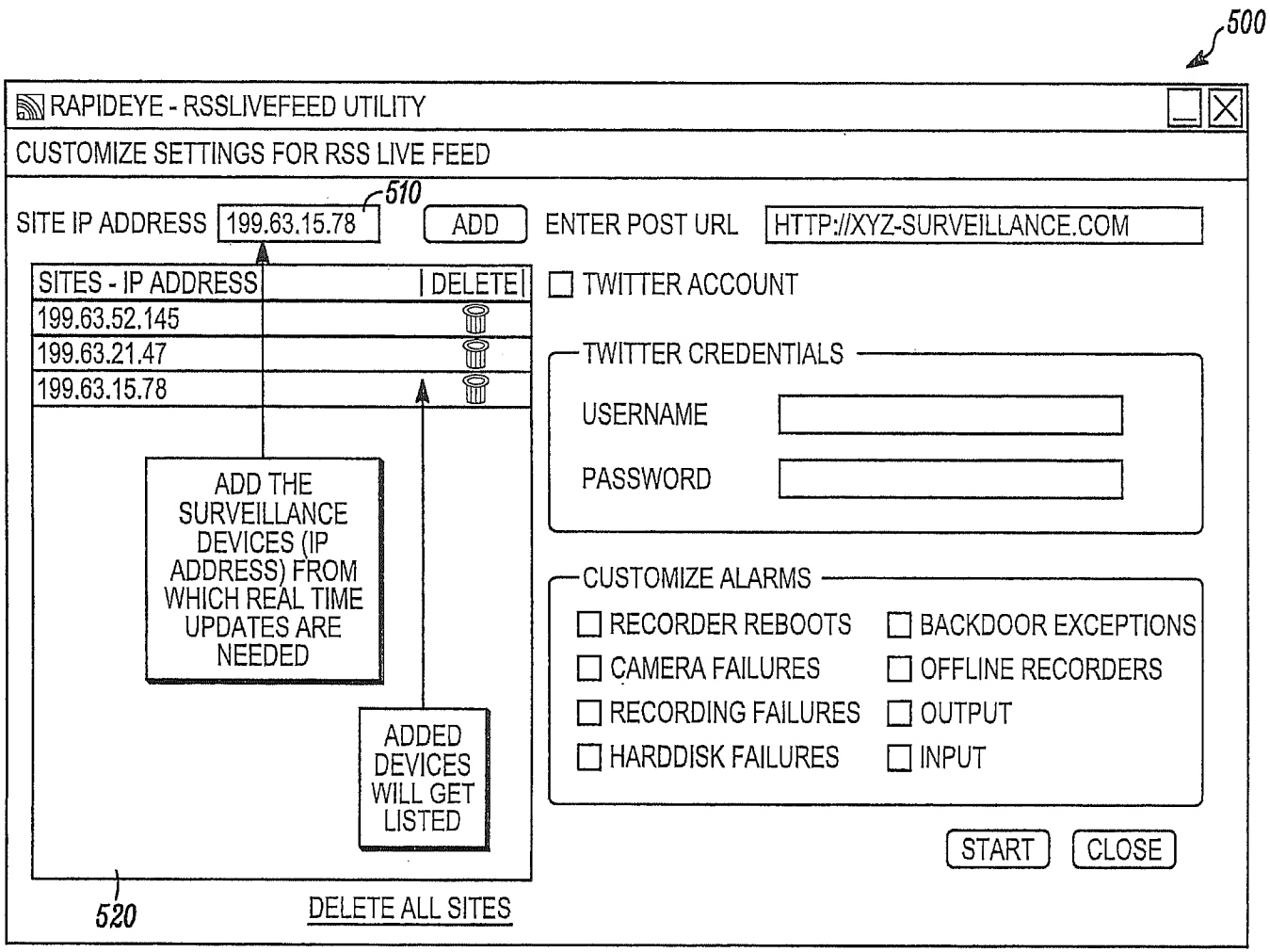
FIG. 5 is an interactive window displayed on a viewing screen of a graphical user interface for selecting surveillance devices for updates in accordance with the present invention.

FIG. 5 is an interactive window 500 displayed on a viewing screen of a graphical user interface for selecting surveillance devices for updates in accordance with the present invention. As seen in FIG. 5, surveillance devices from which real time updates are wanted can be added via a box 510. For example, the IP address of the desired surveillance device can be typed into the box 510. All surveillance devices added can be displayed in a list in a box 520.

Figure 6:
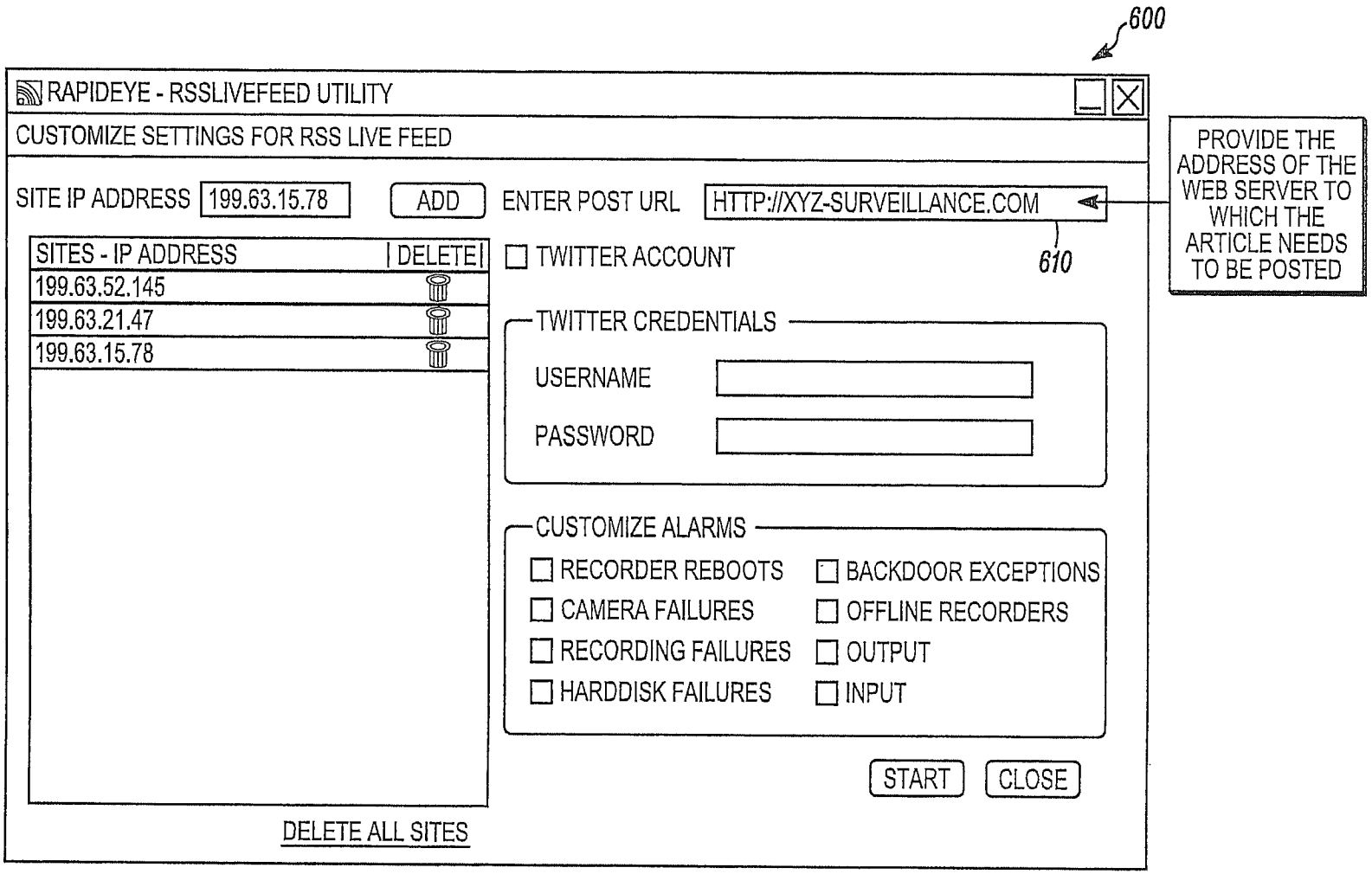
FIG. 6 is an interactive window displayed on a viewing screen of a graphical user interface for configuring a web server address in accordance with the present invention.

FIG. 6 is an interactive window 600 displayed on a viewing screen of a graphical user interface for configuring a web server address in accordance with the present invention. As seen in FIG. 6, the address of a web server to which alarm notifications and/or HTML articles should be posted can be entered in a box 610. For example, a web address of the server can be typed into the box 610.

Figure 7:
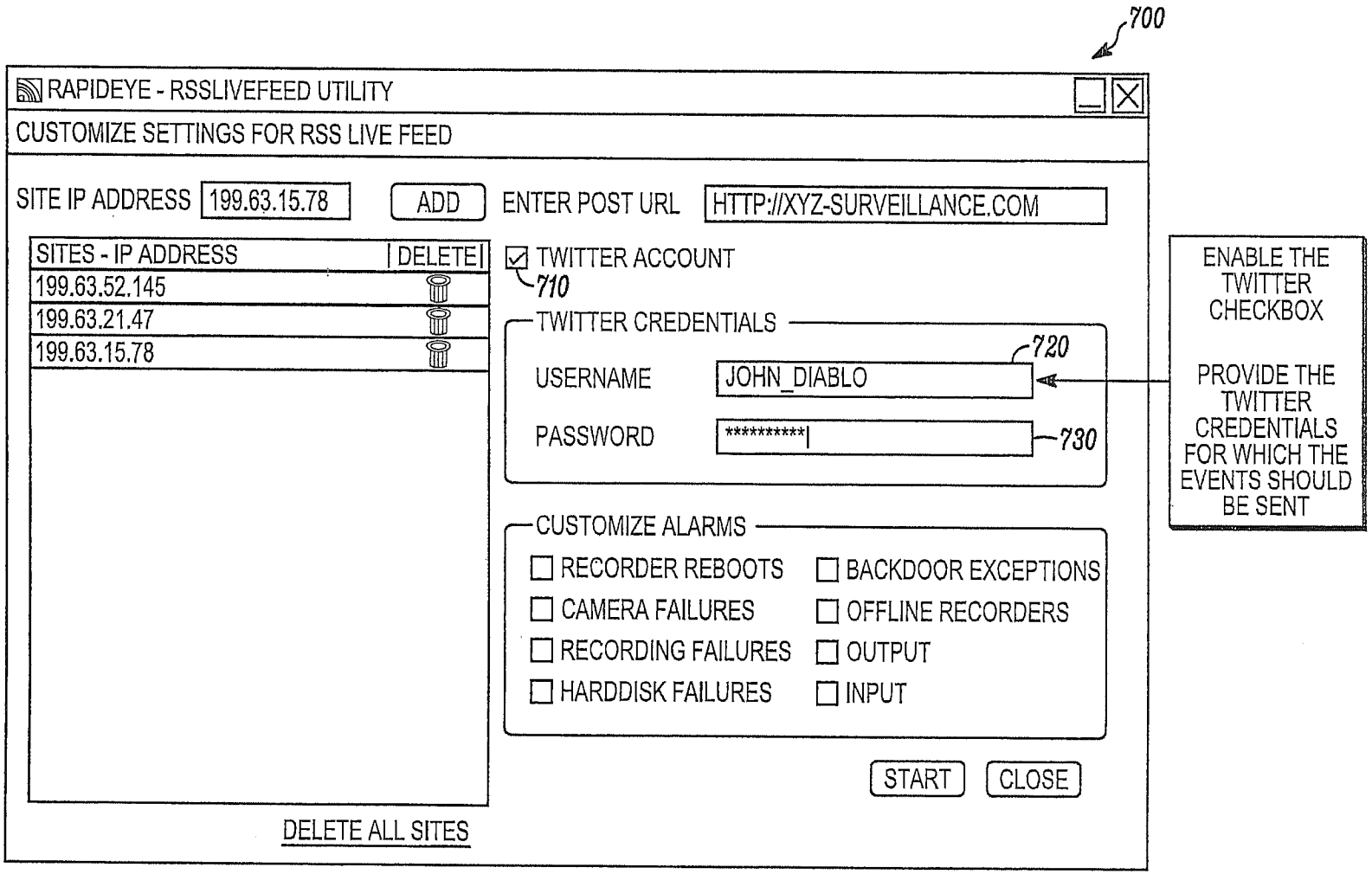
FIG. 7 is an interactive window displayed on a viewing screen of a graphical user interface for configuring a micro blogging service in accordance with the present invention.

FIG. 7 is an interactive window 700 displayed on a viewing screen of a graphical user interface for configuring a micro blogging service in accordance with the present invention. As seen in FIG. 7, the micro blogging service can be enabled by selecting a box 710 and entering user credentials in boxes 720 and 730 to which alarm notifications should be sent. For example, the box 710 can be checked to select the micro blogging service, a user name can be typed into the box 720, and a password can be typed into the box 730.

Figure 8:
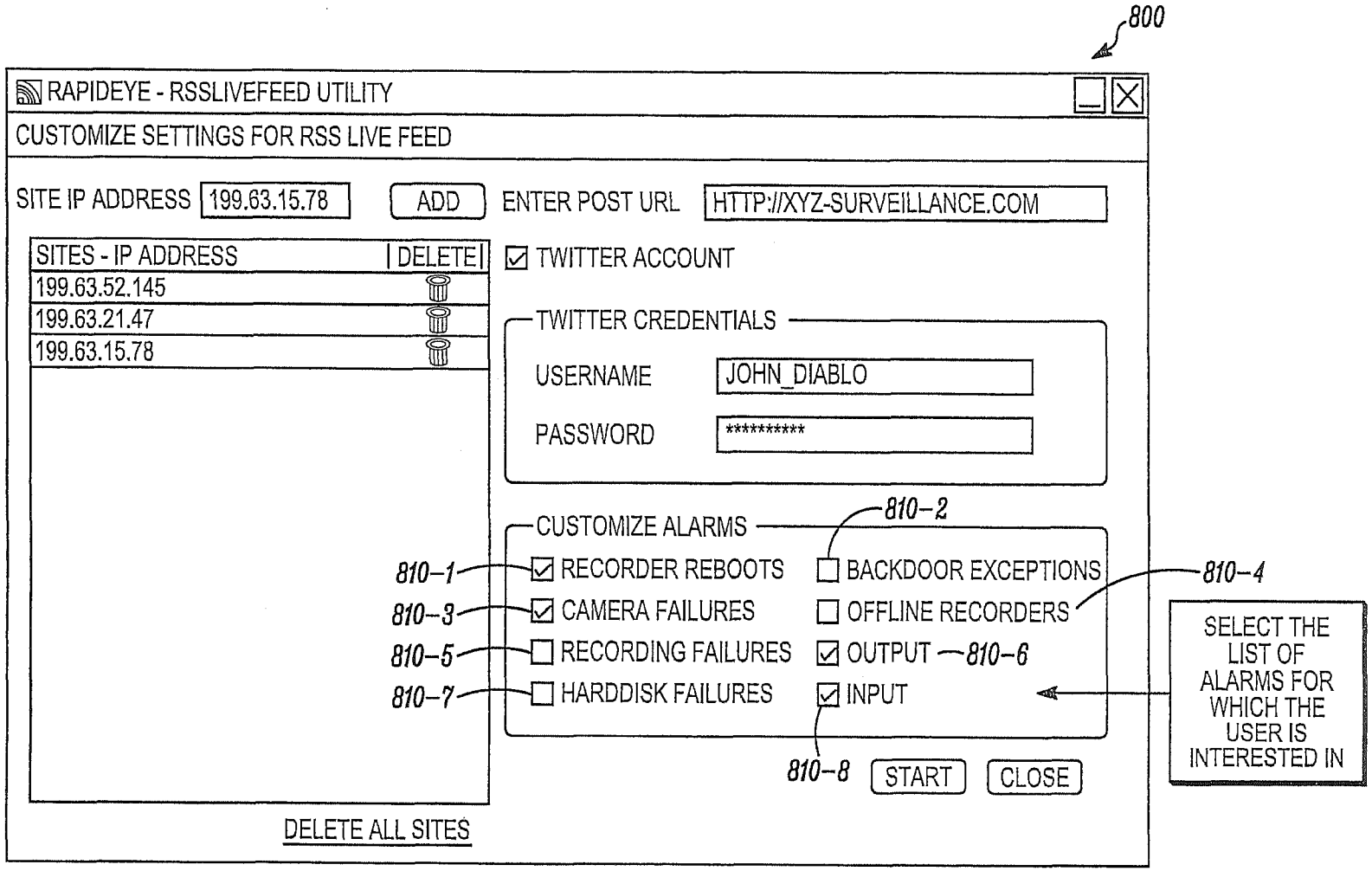
FIG. 8 is an interactive window displayed on a viewing screen of a graphical user interface for configuring alarms in accordance with the present invention.

FIG. 8 is an interactive window 800 displayed on a viewing screen of a graphical user interface for configuring alarms in accordance with the present invention. As seen in FIG. 8, types of alarms in which a user is interested can be selected by selecting a corresponding box for that alarm type from a plurality of boxes 810-1, 810-2, 810-3, 810-4, 810-5, 810-6, 810-7, 810-8. For example, to receive notifications about recorder reboot alarms, the box 810-1 can be checked.

Figure 9:
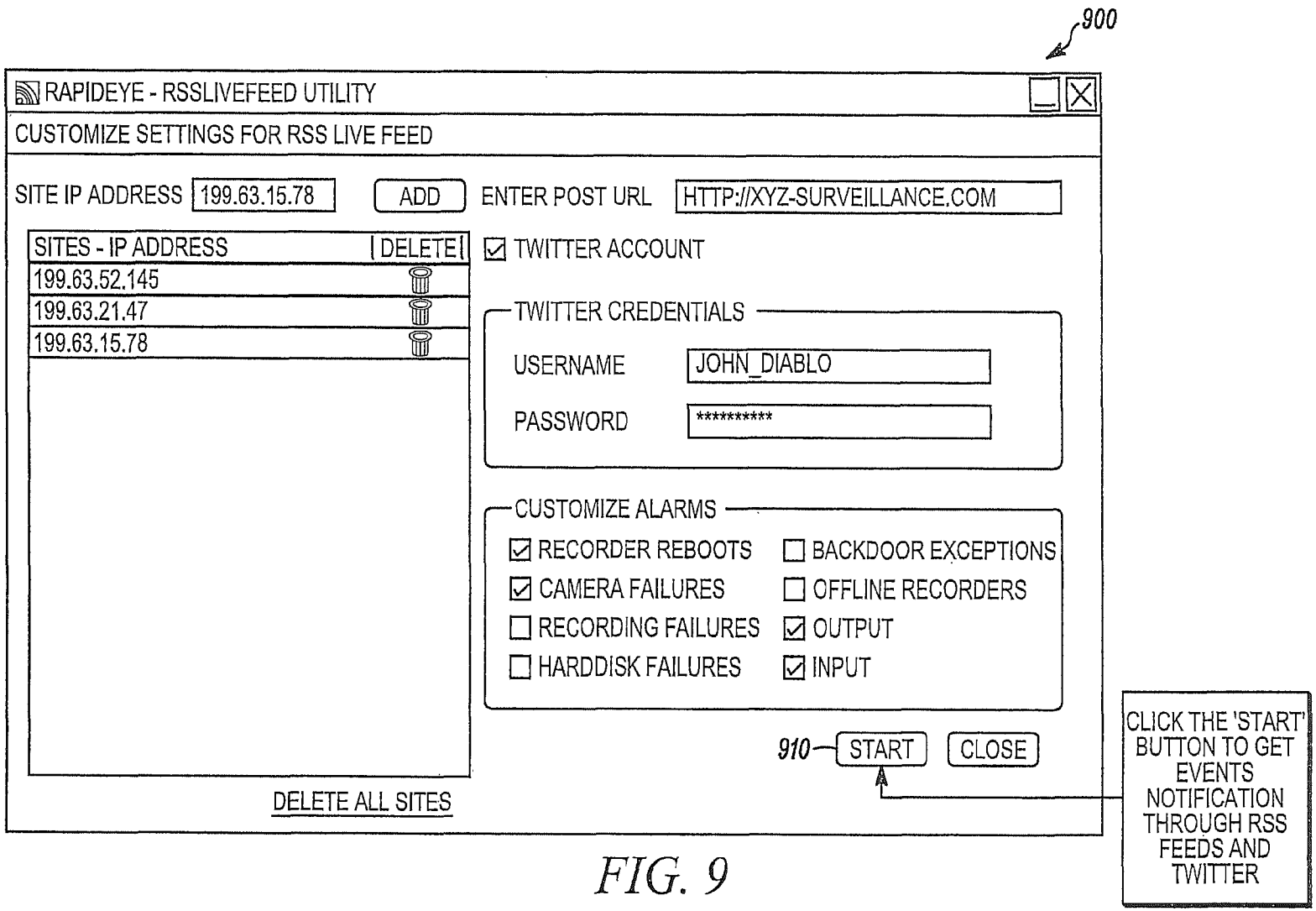
FIG. 9 is an interactive window displayed on a viewing screen of a graphical user interface for starting remote notification in accordance with the present invention.

FIG. 9 is an interactive window 900 displayed on a viewing screen of a graphical user interface for starting remote notification in accordance with the present invention. As seen in FIG. 9, when the surveillance devices for updates are selected and the web server address, micro blogging service, and alarms are configured, remote notification via RSS feeds and the micro blogging service can be started. For example, a start icon or button 910 can be selected.

Figure 10:
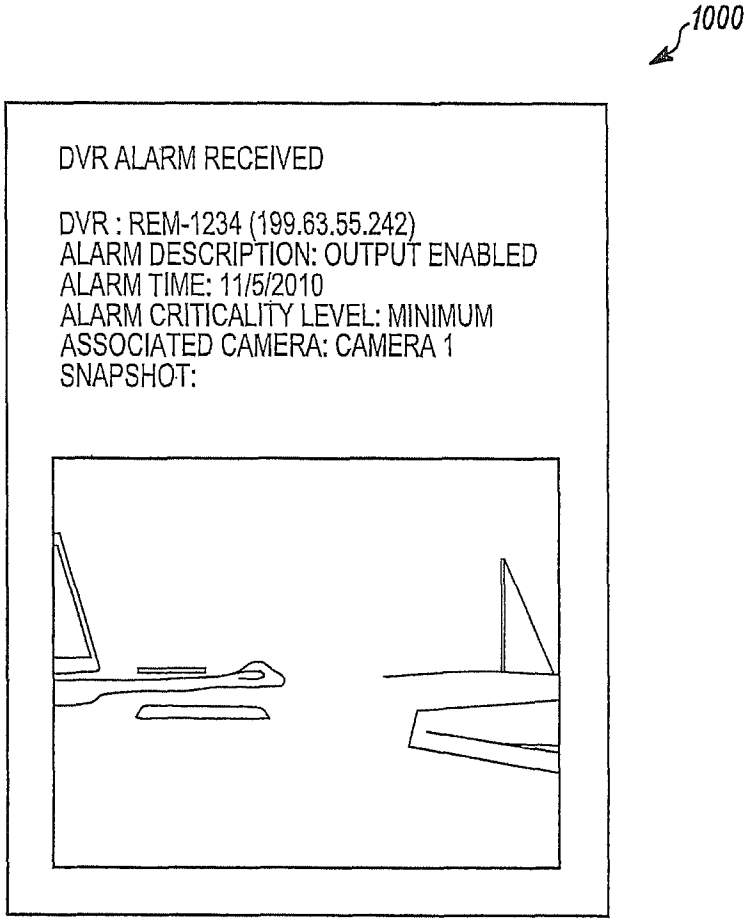
FIG. 10 is a window displayed on a viewing screen of a handheld device for providing remote notification of a single alarm in accordance with the present invention.

FIG. 10 is a window 1000 displayed on a viewing screen of a handheld device for providing remote notification of a single alarm in accordance with the present invention. As seen in FIG. 10, the window 1000 can display the following information on a user's handheld device: the DVR from which the alarm originated, a description of the alarm, the time of the alarm, the critical level of the alarm, a camera that captured the area of the alarm, and snapshot of the area of the alarm.

Finally, FIG. 11 is a window 1100 displayed on a viewing screen of a handheld device for providing remote notification of multiple alarms in accordance with the present invention. When a central station consolidates alarm information from multiple DVRs, the window 1100 can display the consolidated information to a user on his handheld device.

Although a few embodiments have been described in detail above, other modifications are possible. For example, the logic flows depicted in the figures do not require the particular order shown or sequential order to achieve desirable results. Other steps may be provided, steps may be eliminated from the described flows, and other components may be added to or removed from the described systems. Other embodiments may be within the scope of the following claims.

From the foregoing, it will be observed that numerous variations and modifications may be effected without departing from the spirit and scope of the invention. It is to be understood that no limitation with respect to the specific system or method illustrated herein is intended or should be inferred. It is, of course, intended to cover by the appended claims all such modifications as fall within the spirit and scope of the claims.

What is claimed is:

1. A method comprising:

a user interface of a central management system receiving a first selection of a plurality of surveillance devices;

the user interface receiving access credentials for a notification platform;

the user interface receiving a second selection of a plurality of alarm types;

the central management system receiving a first alarm and associated first alarm information from a first of the plurality of surveillance devices;

the central management system determining whether the first of the plurality of surveillance devices matches any of the plurality of surveillance devices in the first selection and whether a first alarm type of the first alarm matches any of the plurality of alarm types in the second selection;

the central management system automatically consolidating the first alarm and the associated first alarm information into a compilation formatted for posting on the notification platform when the central management system determines that the first of the plurality of the surveillance devices matches any of the plurality of surveillance devices in the first selection and the first alarm type of the first alarm matches any of the plurality of alarm types in the second selection;

the central management system automatically posting the compilation to the notification platform immediately after the first alarm and the associated first alarm information are consolidated into the compilation; and the central management system providing a remote notification to a mobile handheld device via the notification platform when the central management system posts the compilation to the notification platform.

2. The method of claim 1 wherein the central management system provides the remote notification to the mobile handheld device via the notification platform substantially immediately after the first alarm occurs.

3. The method of claim 1 wherein the remote notification includes the associated first alarm information.

4. The method of claim 1 wherein the notification platform includes at least one of a web page, a secure web page, a micro-blogging site, and a social networking site.

5. The method of claim 4 wherein at least one of the web page and the secure web page is RSS enabled.

6. The method of claim 5 further comprising the central management system subscribing to at least one of the web page and the secure web page using the access credentials.

7. The method of claim 1 wherein the compilation includes an article containing the first alarm and the associated first alarm information.

* * * * *